US009281609B2

(12) United States Patent
Suzuki et al.

(10) Patent No.: US 9,281,609 B2
(45) Date of Patent: Mar. 8, 2016

(54) WATERPROOF CONNECTOR CONNECTION STRUCTURE

(71) Applicant: Yazaki Corporation, Minato-ku, Tokyo (JP)

(72) Inventors: Miki Suzuki, Makinohara (JP); Takashi Matsunaga, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/309,963

(22) Filed: Jun. 20, 2014

(65) Prior Publication Data

US 2014/0302711 A1 Oct. 9, 2014

Related U.S. Application Data

(63) Continuation of application No. PCT/JP2012/084251, filed on Dec. 21, 2012.

(30) Foreign Application Priority Data

Dec. 22, 2011 (JP) ..... 2011-282275

(51) Int. Cl.
*H01R 13/52* (2006.01)
*H01R 13/631* (2006.01)
*H01R 13/74* (2006.01)

(52) U.S. Cl.
CPC ..... *H01R 13/5202* (2013.01); *H01R 13/6315* (2013.01); *H01R 13/748* (2013.01)

(58) Field of Classification Search
USPC ..... 439/556, 271, 559, 589, 248, 701
See application file for complete search history.

(56) References Cited

U.S. PATENT DOCUMENTS 7,214,080 B2 * 5/2007 Ichio et al. ..... 439/248
8,147,272 B2 * 4/2012 Rhein ..... 439/556

(Continued)

FOREIGN PATENT DOCUMENTS

CN 100541930 C 9/2009
DE 102004055874 A1 5/2006

(Continued)

OTHER PUBLICATIONS

International Search Report and Written Opinion issued in corresponding International Application No. PCT/JP2012/084251 mailed Feb. 13, 2013.

(Continued)

*Primary Examiner* — Alexander Gilman
(74) *Attorney, Agent, or Firm* — Banner & Witcoff, Ltd.

(57) ABSTRACT

A first connector is fluid-tightly fitted with a second connector through an opening of a mounting wall. The first connector includes a cylindrical spacer fitted into the opening, and a housing having a support part and a housing body. The support part is mounted to a first surface of the mounting wall while being able to be displaced along a plane perpendicular to a connector fitting direction of the first and second connectors. The housing body has a leading end which is inserted in the opening with a clearance. A first ring-shaped seal member is interposed between the opening and the spacer, a second ring-shaped seal member is interposed between the spacer and the support part in the connector fitting direction, and a third ring-shaped seal member is interposed between the second connector and the leading end.

6 Claims, 11 Drawing Sheets

(56) References Cited

U.S. PATENT DOCUMENTS

| | | | | |
|---|---|---|---|---|
| 2002/0155756 | A1* | 10/2002 | Yoshioka | 439/607 |
| 2011/0189888 | A1 | 8/2011 | Rhein | |
| 2012/0003856 | A1* | 1/2012 | Yamaguchi et al. | 439/271 |

FOREIGN PATENT DOCUMENTS

| | | | |
|---|---|---|---|
| EP | 2 456 018 | A1 | 5/2012 |
| JP | H06-045282 | | 6/1994 |
| JP | 2007-080690 | A | 3/2007 |
| WO | 2006/053822 | A1 | 5/2006 |
| WO | 2011/007607 | A1 | 1/2011 |
| WO | 2011/097007 | A1 | 8/2011 |

OTHER PUBLICATIONS

Sep. 1, 2015—(KR) Notice to Submit Response—App 10-2014-7016604.

Oct. 28, 2015—(CN) Notification of the First Office Action—App 201280063967.3.

* cited by examiner

WATERPROOF CONNECTOR CONNECTION STRUCTURE

CROSS REFERENCE TO RELATED APPLICATIONS

This application is a continuation of PCT application No. PCT/JP2012/084251, which was filed on Dec. 21, 2012 based on Japanese Patent Application (No. 2011-282275) filed on Dec. 22, 2011, the contents of which are incorporated herein by reference.

BACKGROUND OF THE INVENTION

1. Field of the Invention

The present disclosure relates to a waterproof connector connection structure.

2. Description of the Related Art

A connector connection structure has been known which easily connects an electric component on a surface of a panel of a vehicle and the like and a wire harness on a backside of the panel by connectors (for example, refer to JP-UM-A-6-45282).

FIG. 11 is a longitudinal sectional view of main parts showing a connection state of a connector connection structure according to the related art. In this connector connection structure, a connector 507 of an electric component 505 that is mounted on a surface 503 of a panel (mounting wall) 501 is connected to a connector 509 for harness on a backside of the panel via a panel hole (opening) 511. The connector 509 for harness in which a female terminal 501 is accommodated is floatably supported to a bracket part 513 via a spring part 515. The bracket part 513 is fixed to a backside of the panel.

When connecting the connector 507 having a male tab terminal 508 to the connector 509, the connector 509 for harness is first assembled to the backside of the panel 501. That is, the bracket part 513 is fixed to a stay 516 on the backside of the panel by a clamp 517. The connector 509 for harness is enabled to float by the spring part 515 in a vertical direction and a horizontal direction. Then, the electric component 505 is mounted on the surface 503 of the panel 501. The connector 507 integrally formed with the electric component 505 is fitted into the connector 509 for harness upon the mounting of the electric component 505. Here, the spring part 515 of the connector 509 for harness enables the smooth connection by an alignment operation that absorbs a mounting dimension error of the electric component 505.

The connector 507 of the electric component 505, which is mounted in an area 525 to be water-sprayed, enables a ring-shaped packing 519 at a leading end thereof to contact the surface 503 of the panel 501, thereby preventing the water and the like from permeating into the connector 507 and the connector 509 for harness.

According to the above connector connection structure, it is possible to easily connect the connectors even at a place at which a user should grope for and connect the connectors each other and to prevent the water and the like from permeating into the connector 507 and the connector 509 for harness.

SUMMARY OF THE INVENTION

However, for a structure where the panel 501 that is a mounting wall and the connector 507 are separate each other or a structure where the connector 507 is inserted and mounted in parallel with the panel 501 and the inserting direction is thus perpendicular to the connector fitting direction, it is not possible to enable the ring-shaped packing 519 to contact the surface 503 of the panel 501. In this case, instead of omitting the ring-shaped packing 519, an O-ring is provided between an outer periphery 521 of the connector 509 for harness and an inner periphery 523 of the connector 507, thereby preventing the water and the like from permeating into the connector 507 and the connector 509 for harness.

However, when the ring-shaped packing 519 is omitted, the panel hole 511 is exposed to the area 525 to be water-sprayed. Thus, the water and the like passes through the panel hole 511, so that it is not possible to prevent the water and the like from permeating into the rear of the panel (the rear of the mounting wall).

The present disclosure has been made to solve the above problems. An object of the present disclosure is to provide a waterproof connector connection structure capable of preventing water and the like from permeating from an opening of a mounting wall while enabling an alignment movement in accordance with center deviation of a fitting direction, which is caused between a connector and a mating connector when fitting the connector.

The above object of the present disclosure is achieved by following configurations.

(1) There is provided a waterproof connector connection structure comprising:

a first connector configured to be mounted to a first surface of a mounting wall having an opening while being inserted into the opening; and a second connector configured to be supported at a second surface of the mounting wall which is opposite to the first surface, wherein the first connector is fluid-tightly fitted with the second connector through the opening of the mounting wall;

wherein the first connector includes:

a cylindrical spacer which is fitted into the opening of the mounting wall; and a housing having a support part and a housing body;

wherein the support part is mounted to the first surface of the mounting wall while being able to be displaced along a plane perpendicular to a connector fitting direction of the first and second connectors;

wherein the housing body is provided to so as to suspend from the support part, and a leading end of the housing body is inserted in the opening with a clearance between an inner periphery of the spacer and an outer periphery of the housing;

wherein a first ring-shaped seal member is interposed between an inner periphery of the opening and an outer periphery of the spacer;

wherein a second ring-shaped seal member is interposed between the spacer and the support part in the connector fitting direction; and wherein a third ring-shaped seal member is interposed between the second connector and the leading end.

According to the waterproof connector connection structure having the above configuration (1), even though the mounting dimension error or center deviation in the fitting direction is caused between the mounting wall and the second connector in fitting the connector, when the first connector is inserted into the opening of the mounting wall, the leading end of the housing body of the first connector, which protrudes from a leading end thereof, is inserted into the opening and then the spacer is inserted into the opening. The leading end which has been inserted in the opening is fitted into the second connector positionally deviated with respect to the mounting wall. At this time, although the spacer is not moved relative to the opening in a radial direction (a direction parallel to the plane perpendicular to the connector fitting direction), the housing body of the housing can move relative to an inner periphery of the spacer in the radial direction. By an alignment operation due to the movement of the housing relative to the spacer, the first connector and the second connector can be securely connected with fitting centers thereof being matched.

Also, a space between the inner periphery of the opening of the mounting wall and the outer periphery of the spacer is sealed by the first ring-shaped seal member, a space between the spacer and the support part of the housing in the connector fitting direction is sealed by the second ring-shaped seal member, and a space between the second connector and the leading end of the housing body is sealed by the third ring-shaped seal member. Therefore, the first connector and the second connector are fluid-tightly fitted and connected between one side surface-side and the other surface-side through the opening of the mounting wall. As a result, the water and the like is securely prevented from being introduced from the opening of the mounting wall.

For example, a locking mechanism that restricts the spacer from moving in the connector fitting direction is provided between the inner periphery of the spacer and the outer periphery of the housing body.

According to the waterproof connector connection structure having the above configuration (2), it is possible to assemble the housing of the first connector and the spacer and to improve the assembling operability when fitting and connecting the first connector to the second connector.

For example, the third ring-shaped seal member is interposed between an inner periphery of the second connector and the outer periphery of the housing body.

According to the waterproof connector connection structure having the above configuration (3), it is possible to securely prevent the water and the like from permeating into the first connector and second connector, irrespective of the deviation of the fitting direction, which is caused due to the mounting dimension error between the mounting wall and the second connector.

According to the waterproof connector connection structure of the present disclosure, it is possible to prevent the water and the like from permeating from the opening of the mounting wall while enabling the alignment movement in accordance with the center deviation of the fitting direction, which is caused between the connector and the mating connector when fitting the connector.

The present disclosure has been briefly described. The present disclosure will be more clarified by reading the illustrative embodiments of the present disclosure with reference to the accompanying drawings.

DETAILED DESCRIPTION OF THE EXEMPLARY EMBODIMENTS

Figure 1:
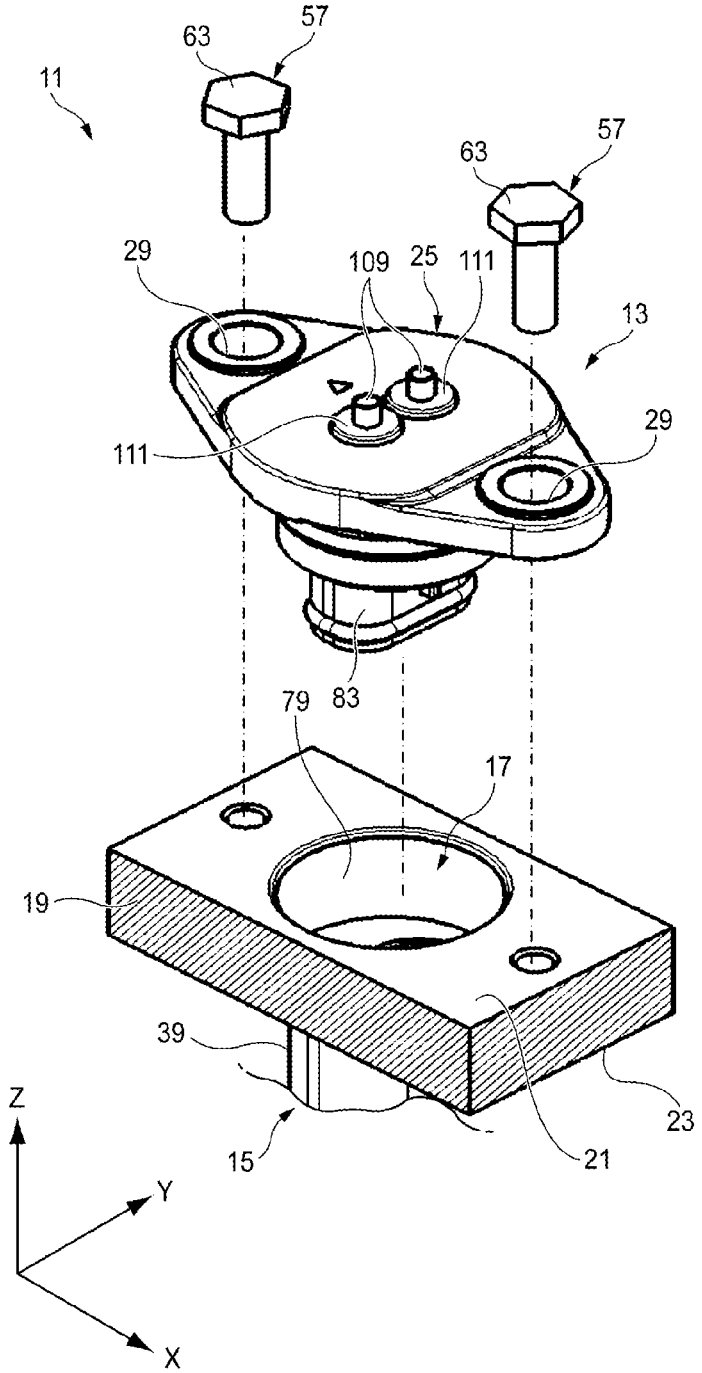
FIG. 1 is an exploded perspective view of a waterproof connector having a waterproof connector connection structure according to an illustrative embodiment of the present disclosure.

Hereinafter, illustrative embodiments of the present disclosure will be described with reference to the drawings.

As shown in FIGS. 1 to 4, a waterproof connector 11 having a waterproof connector connection structure according to an illustrative embodiment of the present disclosure includes a first connector 13 and a second connector 15.

The first connector 13 is mounted to a front surface 21 of the mounting wall 19 of a vehicle member 43, which is a first surface of the mounting wall 19 having an opening 17 (refer to FIG. 4), with being inserted into the opening 17. The second connector 15 is supported by a separate member 46 at a back surface 23 of the mounting wall 19 of the vehicle member 43, which is a second surface of the mounting wall 19. In the waterproof connector 11, the first connector 13 and the second connector 15 are fluid-tightly fitted and connected through the opening 17 of the mounting wall 19. Also, in the specification, the fitting sides of the first connector 13 and the second connector 15 are described as the front and the opposite sides thereto are referred to as the rear.

Figure 2:
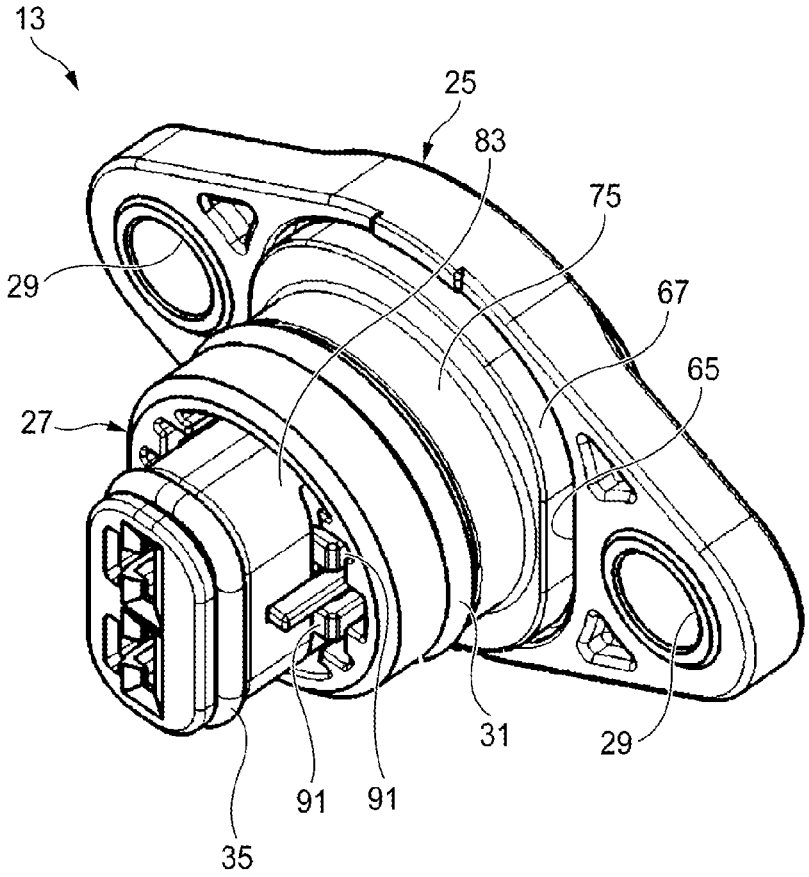
FIG. 2 is a perspective view of a first connector shown in FIG. 1.
Figure 3:
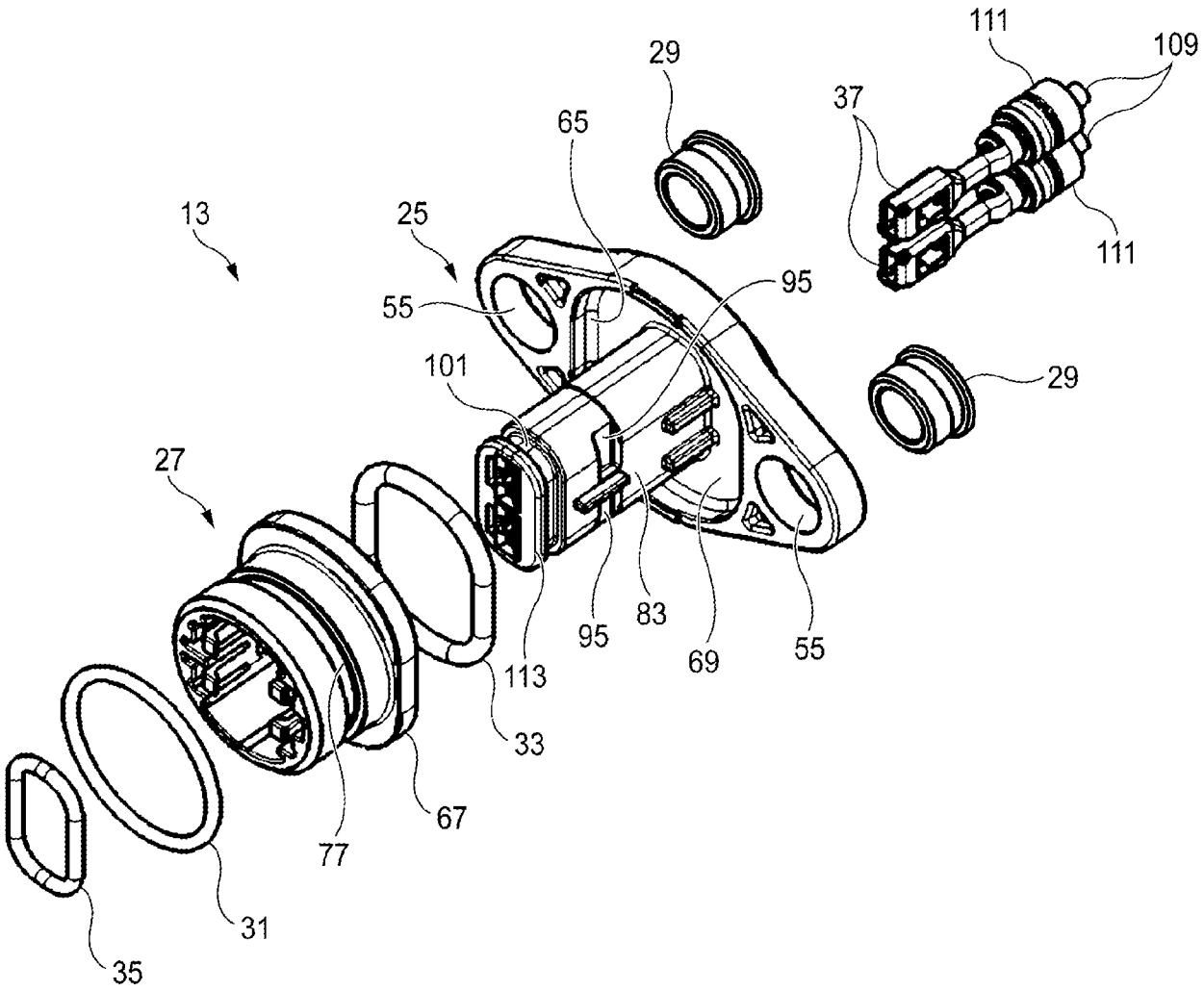
FIG. 3 is an exploded perspective view of the first connector shown in FIG. 2.

As shown in FIGS. 2 and 3, the first connector 13 of this illustrative embodiment has a housing 25 made of synthetic resin, a spacer 27 made of synthetic resin, collars 29, a first ring-shaped seal member 31, a second ring-shaped seal member 33, a third ring-shaped seal member 35 and female terminals 37 that are connected to end portions of electric wires 109.

Figure 4:
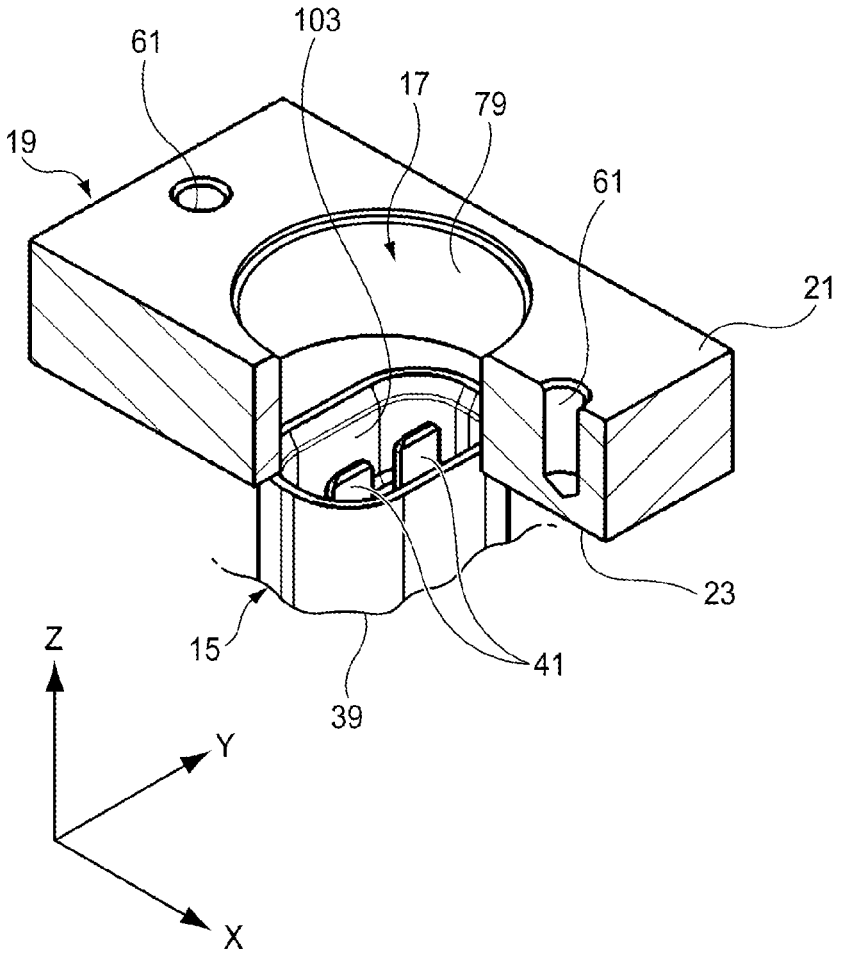
FIG. 4 is a perspective view showing a mounting wall of a second connector shown in FIG. 1, in which a part of the mounting wall is cut out.

As shown in FIG. 4, the second connector 15 of this illustrative embodiment is arranged at a side (lower side of FIG. 4) of the back surface 23 of the mounting wall 19. The second connector 15 accommodates male terminals 41 in a pocket part 39 having an elliptical cylinder shape. The second connector 15 can be referred to as a terminal pocket. The pocket part 39 is integrally formed with the separate member 46 that will be described later.

Figure 5A:
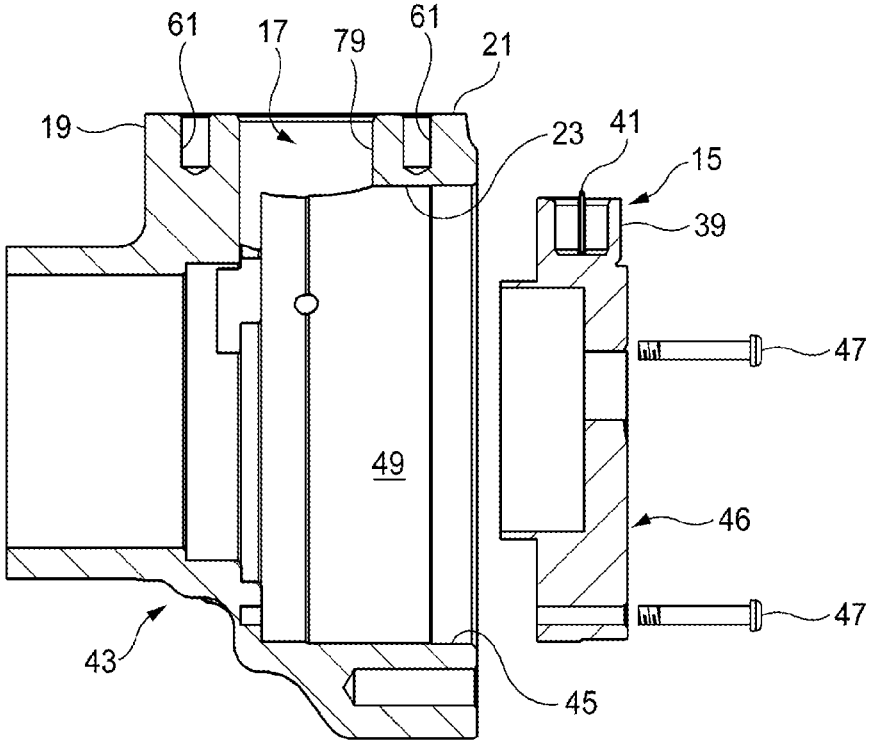
FIG. 5A is an exploded sectional view showing a vehicle member having a mounting wall and a separate member having the second connector and FIG. 5B is a sectional view showing a state where the separate member having the second connector is assembled to the vehicle member having the mounting wall.

As shown in FIG. 5A, the mounting wall 19 of this illustrative embodiment is formed as a part of a housing wall of the vehicle member 43. The vehicle member 43 is formed with an opening 45 that is perpendicular to a central axis of the opening 17. The separate member 46 having the second connector 15 is inserted into the vehicle member 43 from the opening 45 and is fixed by fixation screws 47.

Figure 5B:
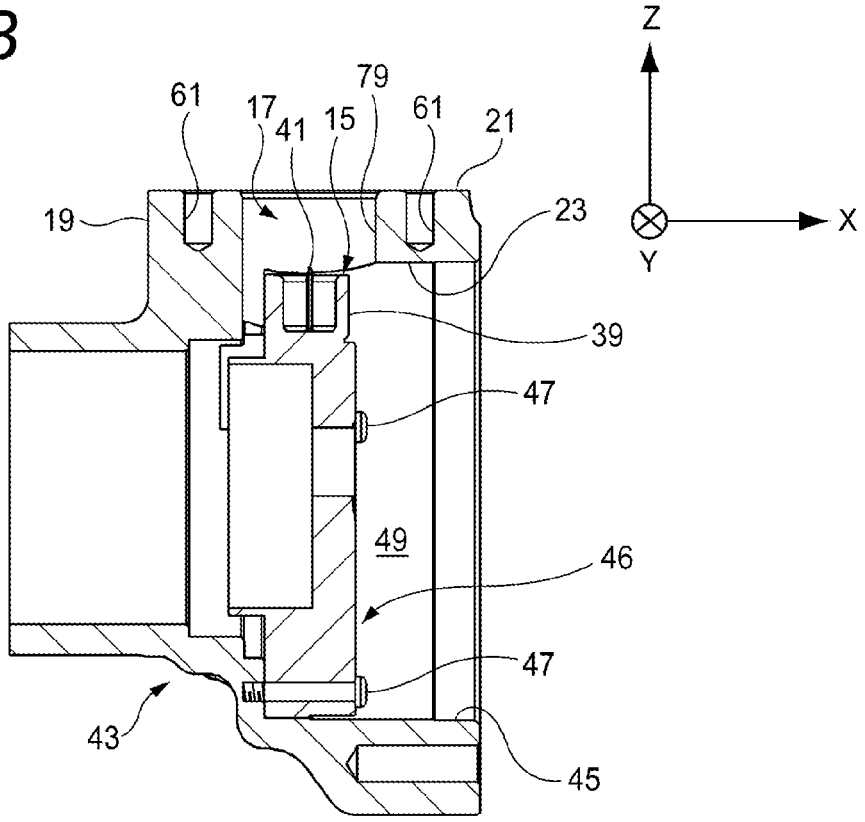

As shown in FIG. 5B, the separate member 46 is fixed to a predetermined position in the vehicle member 43 by the fixation screws 47 and the second connector 15 is positioned at a predetermined position corresponding to the opening 17 of the mounting wall 19. When positioning the second connector 15 with respect to the opening 17, a deviation may be caused due to a dimension error or mounting error of members. The deviation includes a deviation (deviation in the XY direction) in the mounting direction (front-rear direction in FIG. 5B) of the separate member 46 and a deviation (deviation in the Z direction) in the fitting direction (upper-lower direction in FIG. 5B) of the second connector 15. Also, an outside of the separate member 46 in the vehicle member 43 becomes an area 49 to be water-sprayed.

Figure 6:
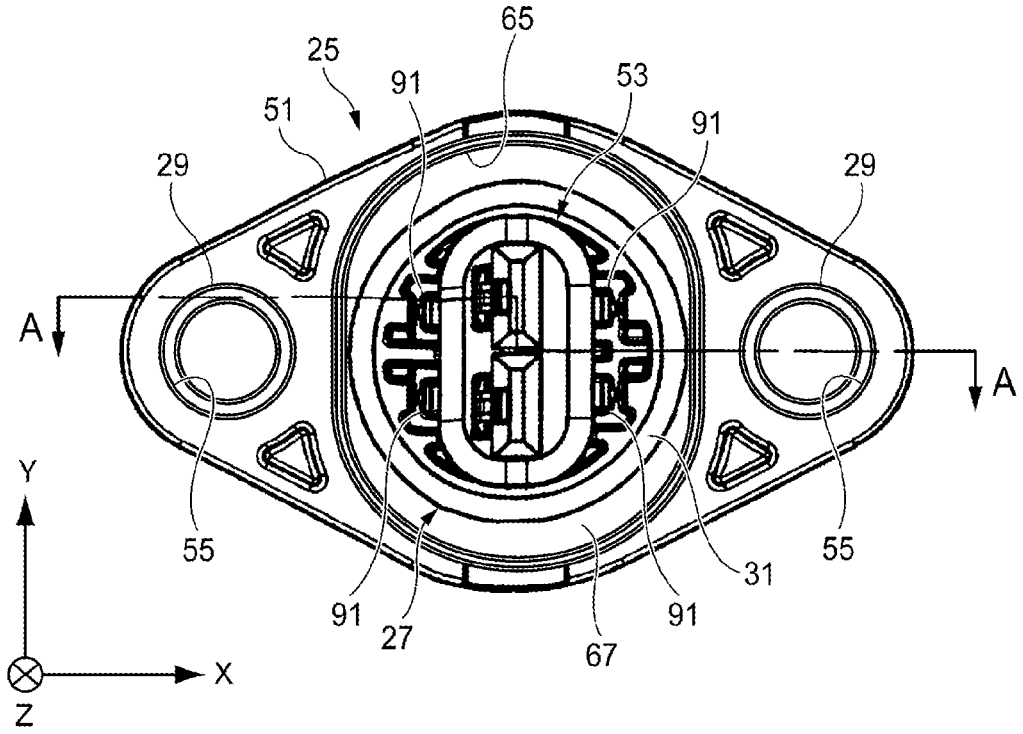
FIG. 6 is a front view of the first connector of FIG. 2, which is seen from the front.
Figure 7:
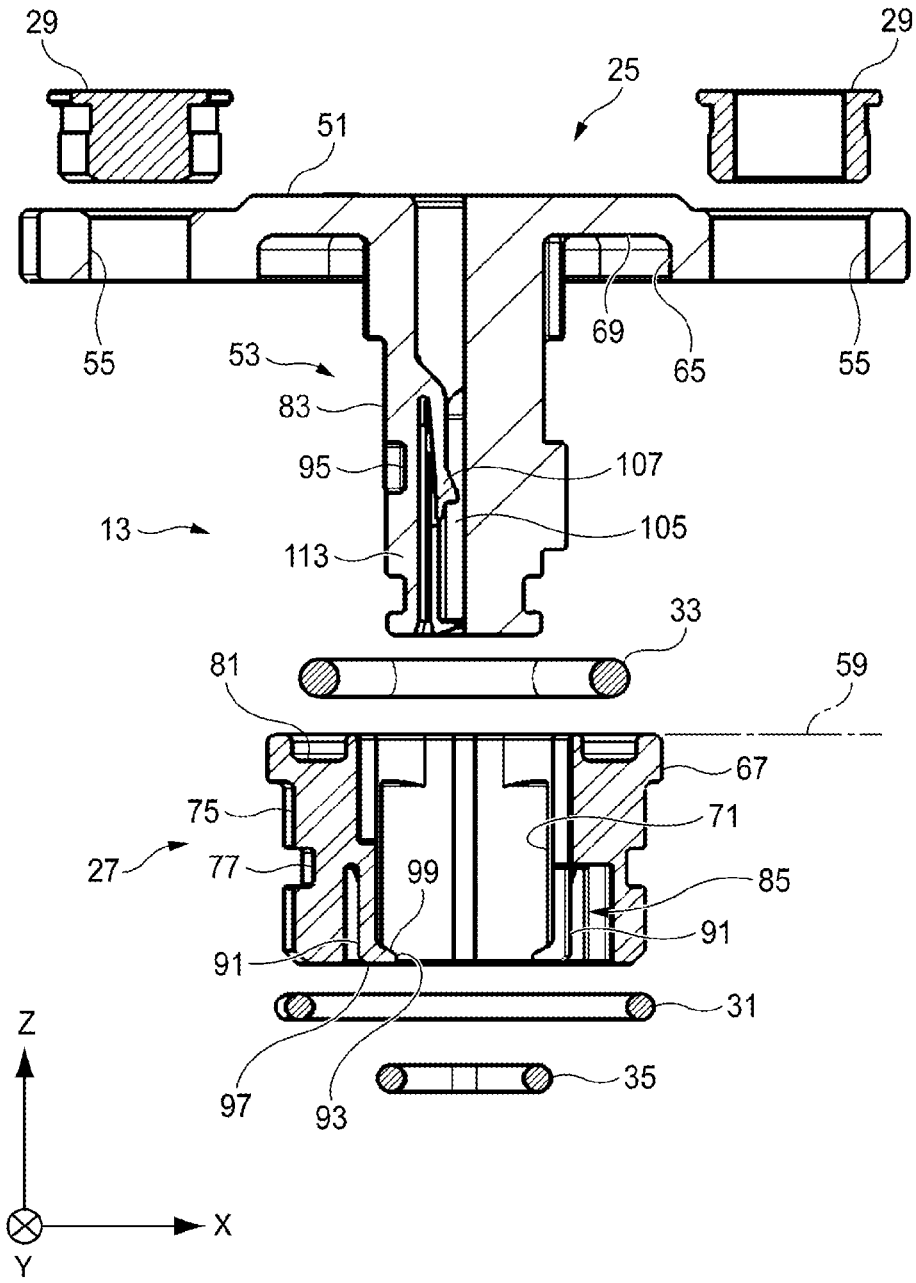
FIG. 7 is an exploded sectional view taken along a line A-A of FIG. 6.

As shown in FIGS. 6 and 7, the housing 25 of this illustrative embodiment has a support part 51 that is mounted on the front surface 21 of the mounting wall 19 and a housing body 53 that is provided to suspend from the support part 51. The support part 51 and the housing body 53 are integrally formed of a resin material, so that the housing 25 has a substantial T-shaped section including an axis line, as shown in FIG. 7.

The support part 51 is shaped in a substantially rhombic flange plate, as shown in FIG. 6. Both ends of the support part 51 are formed with penetrated bolt insertion holes 55. The bolt insertion hole 55 is formed to be sufficiently larger than a shaft diameter of a fixation bolt 57 (refer to FIG. 1). Thereby, the support part 51 is mounted on the front surface 21 of the mounting wall 19 while being able to be displaced along a plane 59 perpendicular to the connector fitting direction. The collar 29 made of metal is inserted into the bolt insertion hole 55 and the fixation bolt 57 is inserted into the collar 29. The fixation bolt 57 is inserted into the collar 29 and is screw-engaged with a female screw hole 61 of the mounting wall 19, so that a bolt head part 63 fixes the support part 51 made of the synthetic resin to the front surface 21 of the mounting wall 19 via the collar 29. That is, the support part 51 of the housing 25 is fixed to the front surface 21 of the mounting wall 19 by the fixation bolts 57.

The support part 51 is formed with a circular ring groove 65 for accommodating a flange part 67. The circular ring groove 65 surrounds a base part of the housing body 53. As shown in FIG. 3, the circular ring groove 65 has an elliptical outward shape. The flange part 67 that is formed at the rear of the spacer 27, which will be described later, is accommodated in the circular ring groove 65. A groove bottom 69 of the circular ring groove 65 is flat, so that it is fluid-tightly contacted to the second ring-shaped seal member 33, which is mounted between the circular ring groove 65 and the flange part 67. An inner diameter of the circular ring groove 65 is larger than an outer diameter of the flange part 67. That is, the circular ring groove 65 accommodates the flange part 67 in a state that the flange part 67 is movable along the plane 59 perpendicular to the connector fitting direction. The housing body 53 perpendicularly protrudes from a center of the circular ring groove 65 of the support part 51.

The housing body 53 has an elliptical shape that is a sectional shape in a direction perpendicular to the axis line. The cylindrical spacer 27 is inserted to the housing body 53 at an outside thereof. An outer diameter of the housing body 53 is smaller than an inner diameter of the spacer 27. Therefore, the housing body 53 inserted into the spacer 27 with a clearance between an inner periphery 71 of the spacer 27 and an outer periphery 83 of the housing body 53.

As shown in FIGS. 6 and 7, the spacer 27 of this illustrative embodiment has a cylindrical shape that is fitted into the opening 17 of the mounting wall 19. The housing body 53 is inserted into the spacer 27. A cylindrical seal groove 77 is provided on an outer periphery 75 of the spacer 27 and the first ring-shaped seal member 31 such as O-ring is mounted into the cylindrical seal groove 77. When the spacer 27 is inserted into the opening 17, the spacer 27 fluid-tightly seals between the outer periphery 75 of the spacer 27 and the inner periphery 79 of the opening 17.

The flange 67 that protrudes outwards from the outer periphery 75 in the radial direction is formed at the rear of the spacer 27. The flange 67 has an elliptical outward shape. The flange part 67 is formed to have an outer diameter (major axis and minor axis) larger than the inner diameter of the opening 17 and to have an outer diameter (major axis and minor axis) smaller than the inner diameter of the circular ring groove 65. That is, the flange part 67 is moved inwards and accommodated in the circular ring groove 65 along the plane 59 perpendicular to the connector fitting direction. An annular groove 81 is formed on a rear end surface of the flange part 67, concentrically with the flange part 67. The rear end surface of the flange part 67 becomes the plane 59 perpendicular to the connector fitting direction. The second ring-shaped seal member 33 is mounted into the ring-shaped groove 81. A part of the second ring-shaped seal member 33, which is accommodated in the ring-shaped groove 81, in a thickness direction (upper-lower direction in FIG. 7) protrudes from the annular groove 81. The protruding part becomes a crushing margin that is crushed and broken by the groove bottom 69 of the circular ring groove 65.

A locking mechanism 85 that restricts the spacer 27 from moving in the connector fitting direction is provided between the inner periphery 71 of the spacer 27 and the outer periphery 83 of the housing body 53. The locking mechanism 85 has a plurality of elastic locking pieces 91 that are mounted on the inner periphery 71 of the spacer 27 and a housing locking part 95 that is formed on the outer periphery 83 (refer to FIG. 3) of the housing body 53. The elastic locking pieces 91 having the same shape are circumferentially arranged on the inner periphery 71 of the spacer 27. A base end of the elastic locking piece 91 is connected to the inner periphery 71 of the spacer 27, so that a leading end thereof becomes a free end protruding forwards along the central axis line of the spacer 27. The free end of the elastic locking piece 91 can be elastically deformed inwards and outwards in the radial direction. The free end is formed with a leading end retaining claw 93 that protrudes inwards in the radial direction.

The leading end retaining claw 93 locks the housing locking part 95 that is formed on the outer periphery 83 (refer to FIG. 3) of the housing body 53. A leading end side of the leading end retaining claw 93 becomes a vertical surface 97 and a rear end side thereof becomes an inclined surface 99 that is estranged rearwards from the housing locking part 85. The inclined surface 99 is a surface for enlarging the elastic locking pieces 91 by a leading end 113 when the housing 25 is inserted from the rear of the spacer 27.

Thus, it is possible to assemble the housing 25 and spacer 27 of the first connector 13 in advance and to improve the assembling operability when fitting and connecting the first connector 13 to the second connector 15.

Figure 8A:
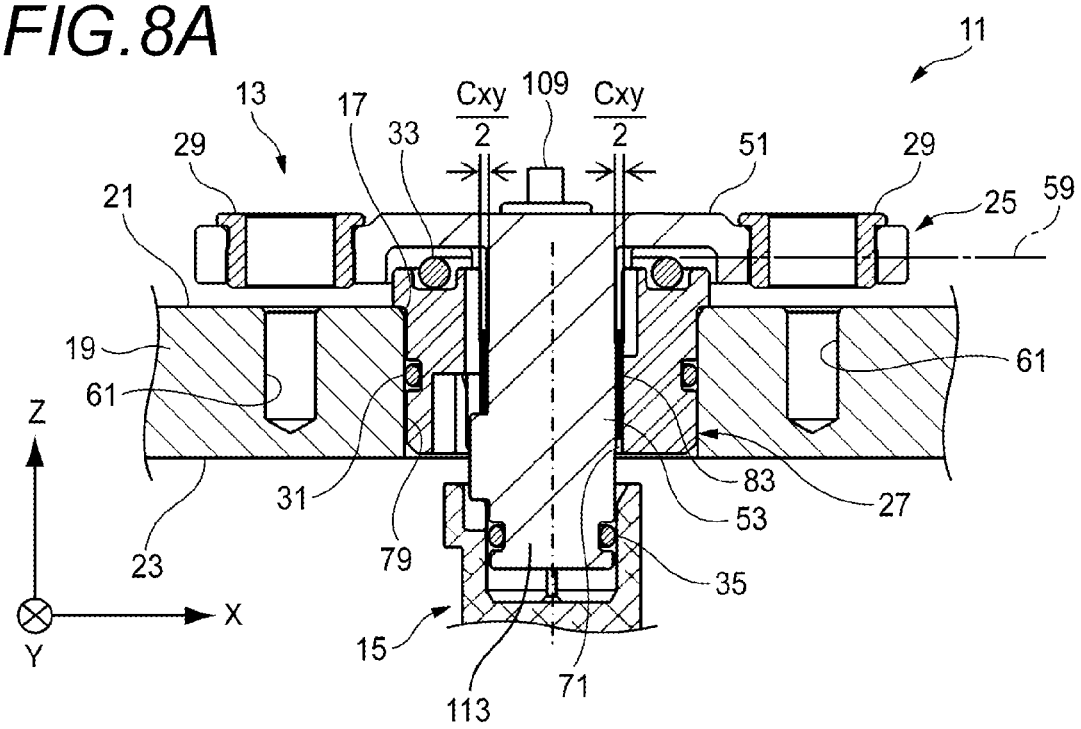
FIG. 8A is a sectional view of the waterproof connector just before the first connector is fitted with the second connector that is not positionally deviated and FIG. 8B is a sectional view of the waterproof connector after a support part of FIG. 8A is fixed.
Figure 8B:
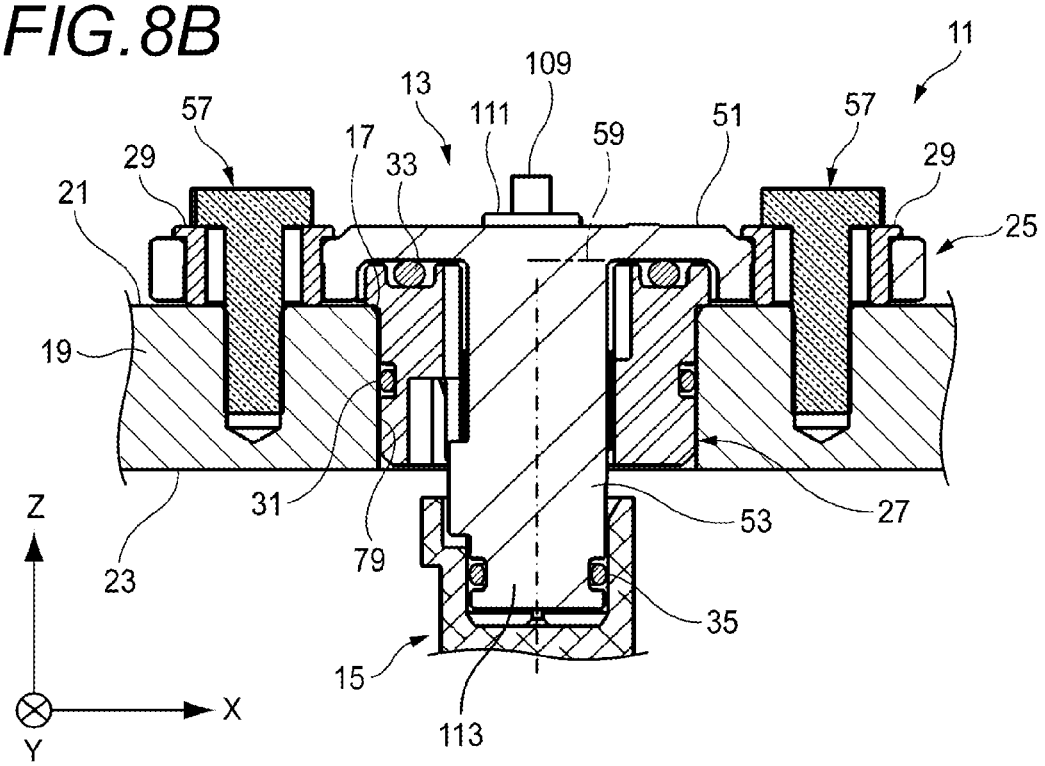

Here, as shown in FIGS. 8A and 8B, the housing body 53 is forms so that a clearance Cxy is formed in the XY direction (direction along the plane 59 perpendicular to the connector fitting direction) between the inner periphery 71 of the spacer 27 and the outer periphery 83 of the housing body 53 in a state that the housing body 53 is inserted into the spacer which is inserted in the opening 17. By the clearance Cxy, the waterproof connector 11 is configured so that the housing 25 of the first connector 13 can move in the spacer 27 along the plane 59 perpendicular to the connector fitting direction.

A front seal groove 101 is formed on the outer periphery 83 of the housing body 53 of this illustrative embodiment. The third ring-shaped seal member 35 is mounted into the front seal groove 101. The third ring-shaped seal member 35 such as O-ring is interposed between an inner periphery 103 (refer to FIG. 4) of the second connector 15 and the outer periphery 83 of the housing body 53, thereby fluid-tightly sealing therebetween.

As shown in FIG. 7, a terminal accommodation chamber 105 is formed in the housing 25. The female terminals 37 (refer to FIG. 3) contacting the male terminals 41 are accommodated in the terminal accommodation chamber 105. The female terminals 37 are restricted from being separated by a lance 107 that is provided in the terminal accommodation chamber 105. The other ends of the electric wires 109, whose one ends are crimped to the female terminals 37, are extend outwards at the rear of the terminal accommodation chamber 105. The electric wires 109 and the terminal accommodation chamber 105 are fluid-tightly sealed therebetween by waterproof plugs 111 (refer to FIG. 3).

In the below, operations of the waterproof connector 11 having the waterproof connector connection structure of the above configuration are described.

Figure 9A:
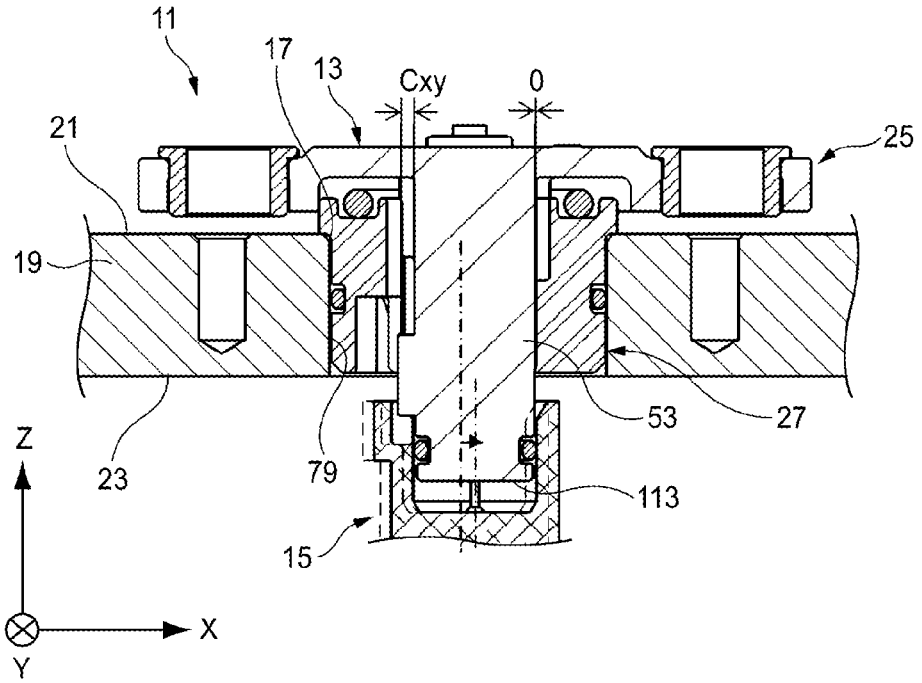
FIG. 9A is a sectional view of a waterproof connector just before the first connector is fitted with the second connector that is positionally deviated and FIG. 9B is a sectional view of the waterproof connector after the support part of FIG. 9A is fixed.
Figure 9B:
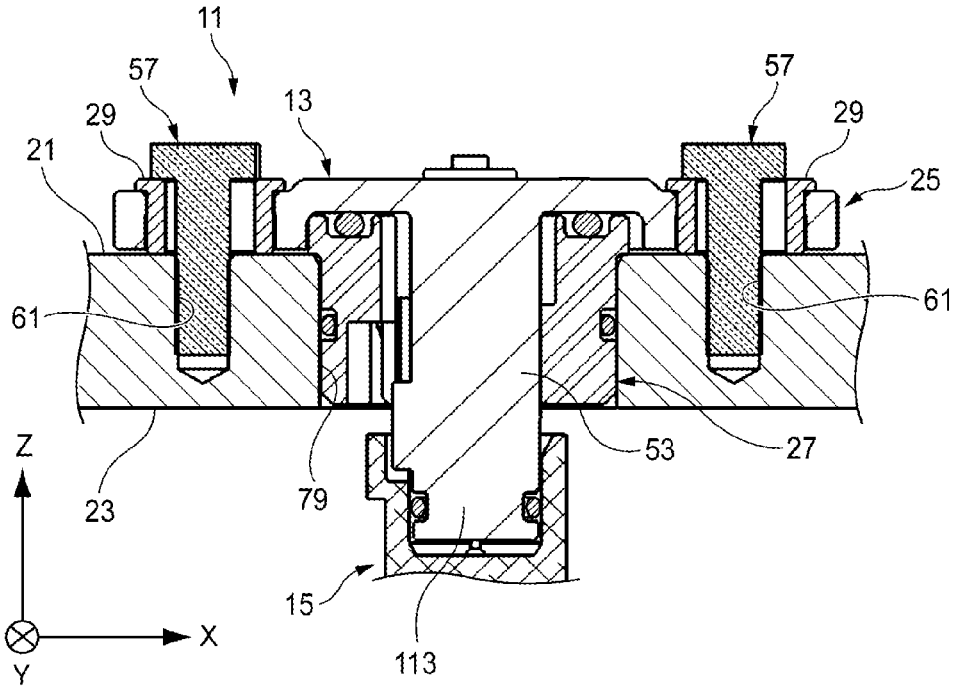

Even though the mounting dimension error or center deviation in the fitting direction is caused between the mounting wall 19 and the second connector 15 when fitting the connector, as shown in FIG. 9A, the first connector 13 and the second connector 15 of the waterproof connector 11 of this illustrative embodiment can be securely connector-connected with the fitting centers being matched, as shown in FIG. 9B.

That is, when the first connector 13 is inserted into the opening 17 of the mounting wall 19, the leading end 113 of the housing body 53 of the first connector 13, which protrudes from the leading end, is inserted into the opening 17 and then the spacer 27 is inserted into the opening 17. The leading end 113 having first penetrated the opening 17 is fitted into the second connector 15 positionally deviated as regards the mounting wall 19.

At this time, although the spacer 27 is not radially moved relative to the opening 17, the housing body 53 of the housing 25 can radially move relative to the inner periphery 71 of the spacer 27.

By the alignment operation due to the movement of the housing 25 relative to the spacer 27, the first connector 13 and the second connector 15 can be securely connected with the fitting centers thereof being matched.

Figure 10A:
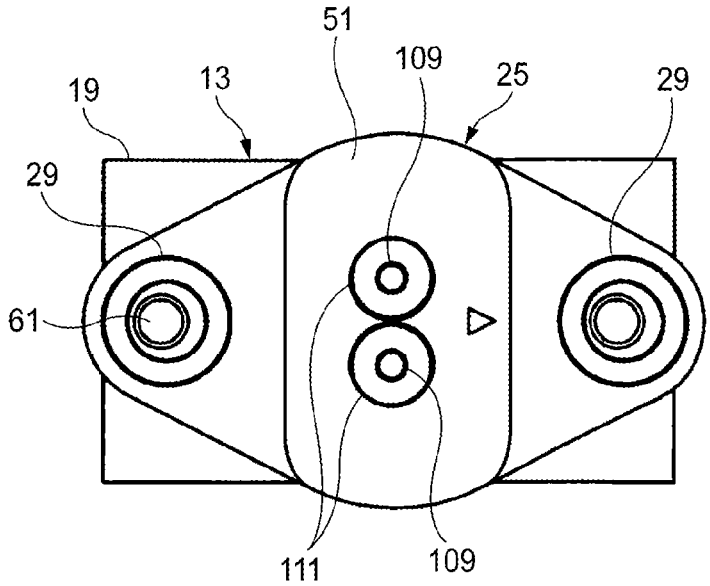
FIG. 10A is a plan view of FIG. 9A
Figure 10B:
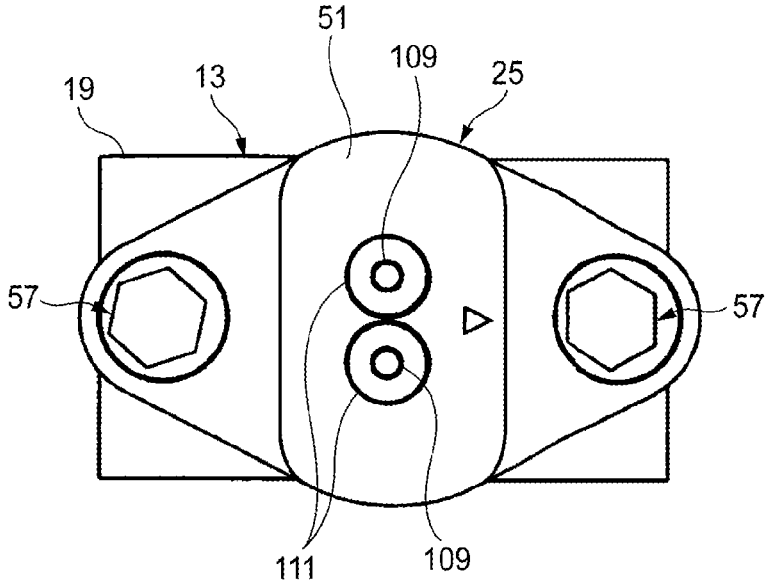
FIG. 10B is a plan view of FIG. 9B.
Figure 11:
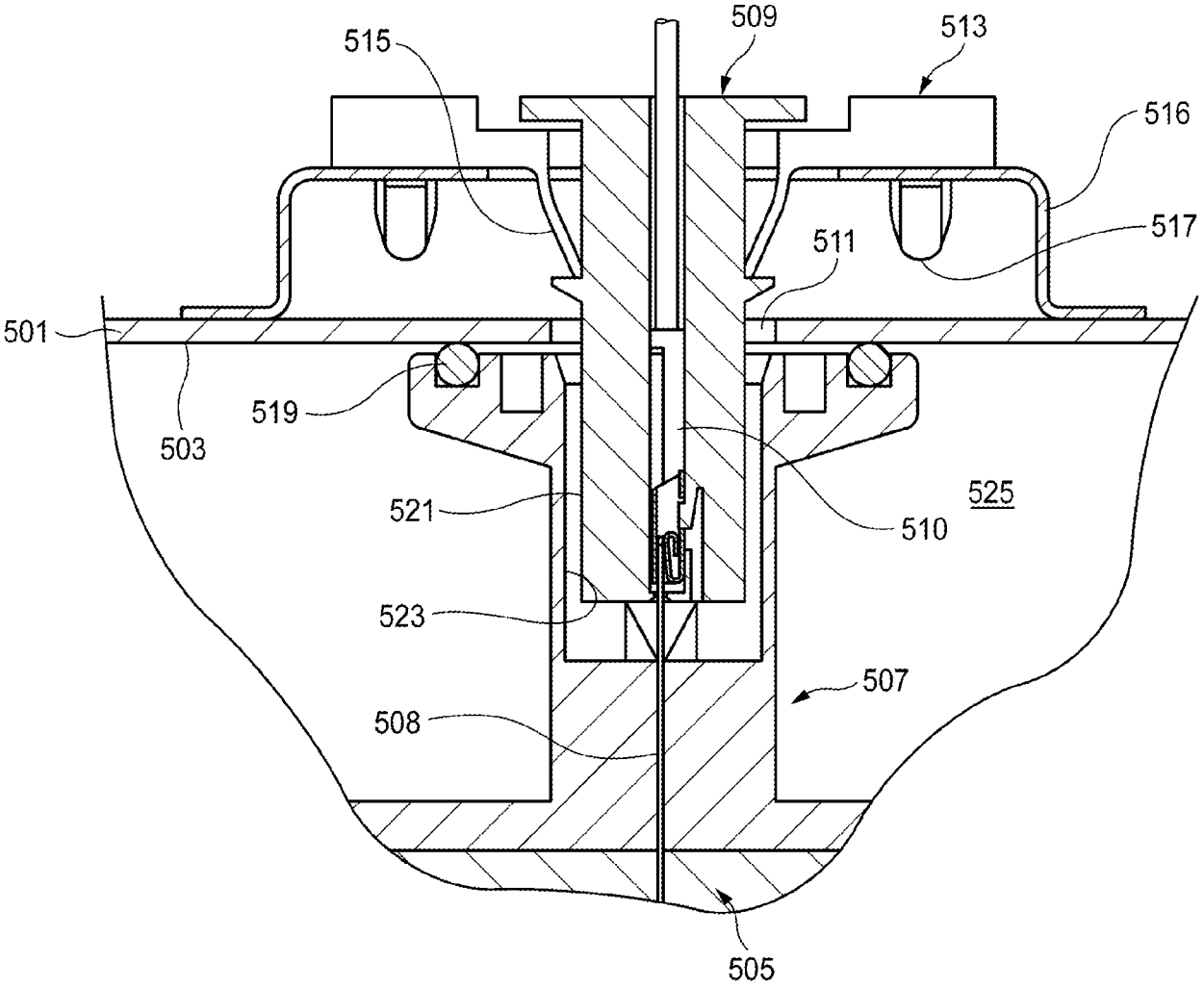
FIG. 11 is a sectional view showing a connector connection structure of the related art.

For example, as shown in FIG. 9A, for a case where the second connector 15 is positionally deviated in the right direction of FIG. 9A relative to the mounting wall 19, when the housing body 53 of the first connector 13 inserted into the spacer 27 is fitted with the second connector 15, the first connector 13 moves at the inside of the spacer 27 in the right direction of FIG. 9A. Therefore, as shown in FIG. 10A, the female screw holes 61 are eccentrically arranged in the left direction of the collars 29. That is, the housing 25 of the first connector 13 is configured to correct the center deviation within the moveable range (clearance Cxy) from side to side and up and down at the inside of the spacer 27. After the first connector 13 and the second connector 15 are fitted, the fixation bolts 57 are inserted into the collars 29 and screw-engaged with the female screw holes 61, as shown in FIGS. 9B and 10B, so that the first connector 13 is fixed to the mounting wall 19.

Also, a space between the inner periphery 79 of the opening 17 of the mounting wall 19 and the outer periphery 75 of the spacer 27 is sealed by the first ring-shaped seal member 31, a space between the spacer 27 and the support part 51 of the housing 25 is sealed by the second ring-shaped seal member 33, and a space between the inner periphery 103 of the second connector 15 and the outer periphery 83 of the housing body 53 is sealed by the third ring-shaped seal member 35. Therefore, the first connector 13 and the second connector 15 are fluid-tightly fitted and connected between a side of the front surface 21 of the mounting wall and a side of the back surface 23 of the mounting wall 19 through the opening 17 of the mounting wall 19. As a result, it is possible to securely prevent the water and the like from being introduced from the opening 17 of the mounting wall 19, irrespective of the deviation of the connector fitting direction, which is caused due to the mounting dimension error between the mounting wall 19 and the second connector 15, the deviation of the mounting direction of the separate member 46 and the like.

Hence, according to the waterproof connector 11 having the waterproof connector connection structure of this illustrative embodiment, it is possible to prevent the water from permeating into the backside of the mounting wall while enabling the movement in accordance with the positional deviation of the connector fitting direction and the alignment movement in accordance with the center deviation of the fitting direction along the plane 59 perpendicular to the connector fitting direction, which deviations are caused between the connector and the mating connector when fitting the connector.

Also, the waterproof connector connection structure of the present disclosure is not limited to the above illustrative embodiment and can be appropriately modified and improved. In addition, the materials, shapes, sizes, number, arrangement locations and the like of the respective constitutional elements of the above illustrative embodiment are arbitrary and are not limited insomuch as the present disclosure can be implemented.

According to the present disclosure, the waterproof connector connection structure which enables to prevent the water from permeating from the opening of the mounting wall while enabling the alignment movement in accordance with the center deviation of the fitting direction, which is caused between the connector and the mating connector when fitting the connector to the mating connector, can be obtained.

What is claimed is:

1. A waterproof connector connection structure comprising:

a first connector configured to be mounted to a first surface of a mounting wall having an opening while being inserted into the opening in an insertion direction; and a second connector configured to be supported at a second surface of the mounting wall which is opposite to the first surface, wherein the first connector is fluid-tightly fitted with the second connector through the opening of the mounting wall, wherein the first connector includes:

a cylindrical spacer which is fitted into the opening of the mounting wall; and a housing having a support part and a housing body, wherein the support part is mounted to the first surface of the mounting wall while being able to be displaced along a plane perpendicular to the insertion direction;

wherein the housing body is provided to so as to suspend from the support part, and a leading end portion of the housing body is inserted in the opening with a clearance between an inner periphery of the spacer and an outer periphery of the housing, wherein a first ring-shaped seal member is interposed between an inner periphery of the opening and an outer periphery of the spacer, wherein a second ring-shaped seal member is interposed between the spacer and the support part in the insertion direction, wherein a third ring-shaped seal member is interposed between the second connector and the leading end portion, and wherein, when the first connector is mounted to the mounting wall:

the support part of the first connector overlaps and directly contacts the second ring-shaped seal member when viewed in the insertion direction, and the second ring-shaped seal member overlaps and directly contacts an end of the spacer when viewed in the insertion direction.

2. The waterproof connector connection structure according to claim 1, wherein a locking mechanism that restricts the spacer from moving in the insertion direction is provided between the inner periphery of the spacer and the outer periphery of the housing body.

3. The waterproof connector connection structure according to claim 1, wherein the third ring-shaped seal member is interposed between an inner periphery of the second connector and the outer periphery of the housing body.

4. The waterproof connector connection structure according to claim 1, wherein the housing body comprises a leading end portion extending beyond the opening of the mounting wall and the cylindrical spacer in the insertion direction when the first connector is mounted to the first surface of the mounting wall, wherein the third ring-shaped seal member overlaps the leading end portion of the housing body when viewed in a direction perpendicular to the insertion direction, and wherein the second connector overlaps the third ring-shaped seal member and the leading end portion of the housing body when viewed in the direction perpendicular to the insertion direction.

5. The waterproof connector connection structure according to claim 1, wherein the second connector is spaced apart from the cylindrical spacer in the insertion direction when the first connector is mounted to the mounting wall and the second connector is fitted to the first connector.

6. The waterproof connector connection structure according to claim 1, wherein, when the first connector is mounted to the mounting wall:

the first ring-shaped seal member is disposed farther downstream in the insertion direction than the second ring-shaped seal member.

* * * * *